US006337543B1

(12) United States Patent
Ge

(10) Patent No.: US 6,337,543 B1
(45) Date of Patent: Jan. 8, 2002

(54) HIGH POWER COLD CATHODE GAS DISCHARGE LAMP USING SUB-ELECTRODE STRUCTURES

(75) Inventor: Shichao Ge, San Jose, CA (US)

(73) Assignee: GL Displays, Inc., Saratoga, CA (US)

( * ) Notice: Subject to any disclaimer, the term of this patent is extended or adjusted under 35 U.S.C. 154(b) by 0 days.

(21) Appl. No.: 09/467,206

(22) Filed: Dec. 20, 1999

(51) Int. Cl.[7] ..... H05B 37/00
(52) U.S. Cl. ..... 315/227 R; 315/167; 315/241 R
(58) Field of Search ..... 315/169.3, 227 R, 315/241 R, 167

(56) References Cited

U.S. PATENT DOCUMENTS 3,833,833 A * 9/1974 Nelson ..... 315/169 TV
4,099,096 A * 7/1978 Holz et al. ..... 315/169 TV
5,461,397 A 10/1995 Zhang et al. ..... 345/102

OTHER PUBLICATIONS

*Flat–Panel Displays and CRTs*, Edited by Lawrence E. Tannas, Jr., Von Nostrand Reinhold, New York, NY 1985, p. 339.

*Applied Illumination Engineering*, Second Edition,Jack L. Lindsey, 1997, published by The Fairmont Press Inc. in Lilburn, GA 30247, p. 61.

"Efficiency Limits for Fluorescent Lamps and Application to LCD Backlighting," R.Y. Pai, *Journal of the SID*, 5/4, 1997, pp. 371–374.

* cited by examiner

*Primary Examiner*—David Vu
(74) *Attorney, Agent, or Firm*—Skjerven Morrill MacPherson

(57) ABSTRACT

A high power cold cathode gas discharge system employs two electrode structures, where each structure includes a plurality of sub-electrodes connected in parallel to a driver so that the current delivered by the system is spread over multiple sub-electrodes. Each sub-electrode is connected to the driver through a current limiting device such as a capacitor which limits the current delivered by each sub-electrode to be below a certain threshold. By spreading the current delivered by the system over multiple sub-electrodes, the useful life of the system will not be reduced because of sputtering, which results in a high power and long life fluorescent lamp and other gas discharge devices.

23 Claims, 4 Drawing Sheets

HIGH POWER COLD CATHODE GAS DISCHARGE LAMP USING SUB-ELECTRODE STRUCTURES

BACKGROUND OF INVENTION

This invention relates in general to cold cathode gas discharge devices, and in particular, to a high power cold cathode gas discharge system.

Hot cathode fluorescent lamps (HCFLs) have been used for illumination. While HCFLs are able to deliver high power, the useful life of HCFLs is typically in the range of several thousand hours. For many applications, it may be costly or inconvenient to replace HCFLs when they become defective after use. It is therefore desirable to provide illumination instruments with a longer useful life. The cold cathode fluorescent lamp (CCFL) is such a device with a useful life in the range of about 20,000 to 50,000 hours.

HCFL and CCFL employ entirely different mechanisms to generate electrons. The HCFL operates in the arc discharge region whereas the CCFL functions in the normal glow region. This is illustrated on page 339 from the book *Flat Panel Displays and CRTS,* edited by Lawrence E. Tannas, Jr., Von Nostrand Reinhold, New York, 1985, which is incorporated herein by reference. The HCFL functions in the arc discharge region. As shown in FIG. 10–5 on page 339 of this book, for the HCFL functioning in the arc discharge region, the current flow is of the order of 0.1 to 1 ampere. The CCFL functions in the normal glow region. Functioning in the normal glow region of the gas discharge, the current flow in the CCFL is of the order of $10^{-3}$ ampere, according to FIG. 10–5 on page 339 of the above-referenced book. Thus, the current flow in the HCFL is about two orders of magnitude or more than that in the CCFL.

The HCFL typically employs a tungsten coil coated with an electron emission layer. For more details, see page 61 of *Applied Illumination Engineering, Second Edition*, Jack L. Lindsey, 1997, published by The Fairmont Press, Inc. in Lilburn, Ga. 30247, which is incorporated herein by reference. A ½ watt or 1 watt of power is needed to heat the tungsten coil to about 1,000° C. At this temperature, the electrons can easily leave the electron emission layer and a small voltage of the order of about 10 volts will pull large currents into the discharge. The large current flow is in the form of a visible arc, so that the HCFL is also known as the arc lamp. The small voltage will also pull ions from the discharge which return to the tungsten coil, thereby ejecting secondary electrons. However, since the cathode-fall voltage (~10 V) is small, the sputtering effect of such ions would be small. The lifetime of an HCFL is determined primarily by the evaporation of the electron emission layer at the high operating temperature of the HCFL.

The CCFL emit electrons by a mechanism that is entirely different from that of the HCFL. Instead of employing an electron emission layer and heating the cathode to a high temperature to make it easy for electrons to leave the cathode, the CCFL relies on a high cathode-fall voltage (~150 V) to pull ions from the discharge. These ions eject secondary electrons from the cathode and the cathode- fall then accelerates the secondary electrons back into the discharge producing several electron-ion pairs. Ions from these pairs return to the cathode. Because of the high cathode-fall voltage (~150 V), the ions are accelerated by the cathode-fall voltage from the discharge to the cathode, thereby causing sputtering. Different from the HCFL, no power is wasted to heat the CCFL to a high temperature.

The HCFL operates at a relatively low voltage (~100 V) whereas the CCFL operates at high voltages (of the order of several hundred volts). The HCFL operates at a temperature of about 40° C. and above, with the cathode operating at a relatively high temperature of about 1,000° C., whereas the CCFL operates in a temperature range of about 30–75° C., with the cathode operating at a temperature of about 150–190° C. For further information concerning the differences between HCFL and a CCFL, please see the paper entitled "Efficiency Limits for Fluorescent Lamps and Application to LCD Backlighting," by R. Y. Pai, *Journal of the SID, May* 5, 1997, pp. 371–374, which is incorporated herein by reference.

CCFLs typically comprise an elongated tube and a pair of electrodes where the current between the electrodes in the CCFL is not more than about 5 milliamps and the power delivered by the CCFLs less than about 5 watts. In order to increase the power delivered by the CCFL, it is possible to increase either the length of (and consequently, the voltage across the CCFL) or the current in the CCFL. It may be difficult to manufacture CCFLs whose tubes are excessively long. Furthermore, when the tube length of the CCFL is excessive, they must be operated at high voltage so that this increases the cost and reduces the reliability of the CCFL drivers. Another way to increase the power output of the CCFL is to increase the current in the CCFL. However, as noted above, because of the high cathode-fall voltage which may be about 150 V, ions are accelerated from the discharge towards the cathode, thereby causing sputtering. This means that if a large current is flowing in the CCFL, the return of the ions to the cathode may cause excessive sputtering, which drastically reduces the useful life of the CCFL.

None of the above-described gas discharge devices are entirely satisfactory. It is, therefore, desirable to provide an improved gas discharge device where the above-described disadvantages are not present.

SUMMARY OF THE INVENTION

This invention is based on the observation that the above-described sputtering caused by the return of the ions to the cold cathode may be reduced by distributing or spreading the current over two or more sub-electrodes rather than a single electrode, so that each sub-electrode is not required to carry excessive current. In this manner, the sputtering that does occur will not be excessive and will not drastically reduce the useful life of a cold cathode gas discharge system. This enables the cold cathode gas discharge system to be capable of being operated at higher current, while at the same time, the useful life of the system will not be significantly reduced by the larger current flow. This enables the system to provide higher power without significantly compromising the useful life of the system.

BRIEF DESCRIPTION OF THE DRAWINGS

For simplicity in description, identical components are labeled by the same numerals in this application.

DETAILED DESCRIPTION OF THE EMBODIMENTS

Figure 1:
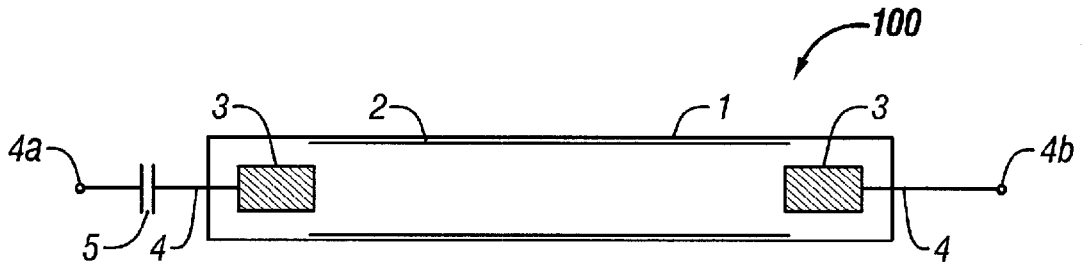
FIG. 1 (Prior Art)
FIG. 1 is a schematic view of a cold cathode gas discharge system to illustrate a conventional CCFL.

FIG. 1 is a schematic view of a conventional CCFL 100. As shown in FIG. 1, CCFL 100 includes a vacuum sealed gas discharge tube 1, which contains gas discharge material such as mercury, xenon and one or more inert gases such as argon, helium, neon or other inert gases. On the inner wall of tube 1 is a fluorescent layer 2. Tube 1 also contains two electrodes 3, one at each end of the tube. A lead 4 for each electrode connects corresponding electrode 3 and passes through one of the ends of tube 1 to outside the tube. One of the leads 4 connects its corresponding electrode 3 through capacitor 5 to a node 4*a*, while the other lead 4 connects the remaining electrode 3 to lead 4*b*. When an appropriate AC voltage is applied between anodes 4*a*, 4*b*, such as an AC voltage at about 30 kHz, the gas discharge in tube 1 generates ultraviolet radiation which excites the phosphor layer 2 to generate visible light. Typically, the current flowing through electrodes 3 is controlled to be less than 5 milliamps because of the sputtering problems discussed above. If the current applied through electrodes 3 exceeds 5 milliamps, the useful life of the CCFL 100 is drastically reduced. From tests which have been conducted, the useful life of a conventional CCFL 100 varies inversely with the square of the current carried by the CCFL. For this reason, the conventional CCFL of the type shown in FIG. 1 is typically used to deliver low power, such as at below 5 watts.

Figure 2:
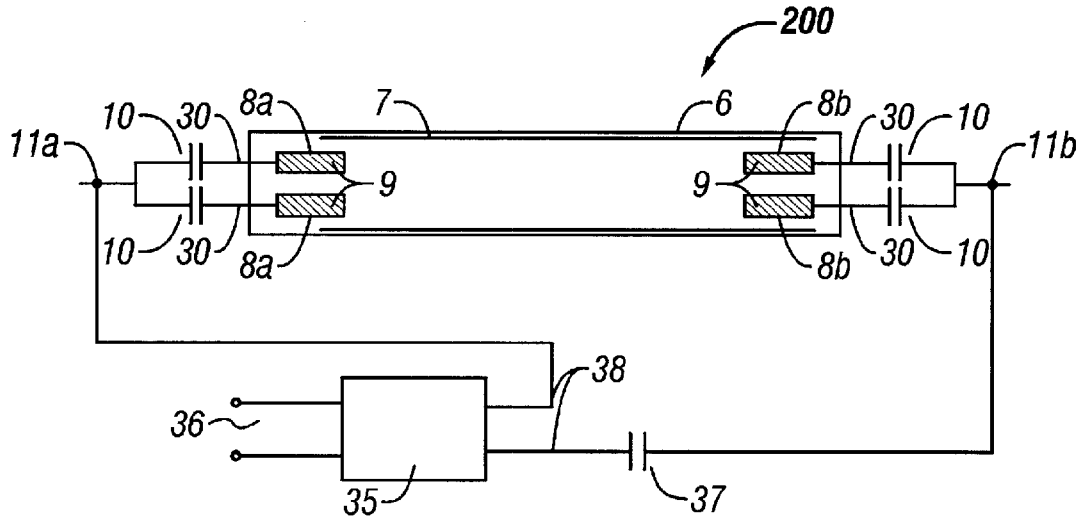
FIG. 2 is a schematic view of a cold cathode gas discharge system useful for illustrating an embodiment of the invention.

FIG. 2 is a schematic view of a cold cathode gas discharge system useful for illustrating the invention. System 200 includes a vacuum sealed container 6 such as a tube, containing gas discharge material such as mercury, xenon and one or more inert gases such as argon, helium, neon or other inert gases. An optional phosphor layer 7 may be employed on the walls of tube 6. Tube 6 contains two pairs of sub-electrodes: pair 8*a* and pair 8*b*. As shown in FIG. 2, each sub-electrode is connected through a corresponding capacitor 10 to nodes 11*a*, 11*b*. When a suitable AC voltage is applied across the nodes 11*a*, 11*b*, such as at 10–100 kHz and 100 V to 50 kV, the current flow between the two pairs of sub-electrodes would cause gas discharge and generation of ultraviolet radiation in tube 6. Where the optional phosphor layer 7 is present on the wall of tube 6, the phosphor layer is caused to generate visible light in response to the ultraviolet radiation. A given color visible light source or a given wavelength ultraviolet light source can then be obtained.

Since the current flow between nodes 11*a*, 11*b* is now spread across two pairs of sub-electrodes 8*a*, 8*b*, the current experienced by any individual sub-electrode is less than that passing between the two nodes, so that the sputtering effect on such sub-electrode is reduced as compared to a situation where the entire current passing between the nodes passes through such sub-electrode. Thus, if the two sub-electrodes in pair 8*a* each carries 5 milliamps of current, this enables a current of 10 milliamps to flow between nodes 11*a*, 11*b*, so that the power delivered by system 200 would be twice that of the conventional CCFL 100 carrying 5 milliamps. While each electrode is embodied in a pair of sub-electrodes (e.g. 8*a*) for a total of two pairs (8*a*, 8*b*) of sub-electrodes as shown in FIG. 2, it will be understood that each electrode may comprise more than two sub-electrodes such as n sub-electrodes may be employed to deliver 5n milliamps of current between n pairs of sub-electrodes, so that the power delivered by such device will be 5n watts, where n is a positive integer greater than 1.

A lead 30 for each sub-electrode is connected to its corresponding electrode 8*a* or 8*b* and passes through one of the ends of tube 6 to outside the tube to a driver 35 and capacitor 37 through leads 38. Driver 35 receives power from a power supply (not shown) such as a power outlet connected to a power utility company through leads 36. Layer 7 is a phosphor layer deposited on the inner wall of the tube 6. Where a DC voltage is used to operate the CCFL, the capacitor 37 may be omitted.

When a suitable DC voltage, or a suitable AC voltage, is applied across the sub-electrodes 8*a*, 8*b* by means of a power supply and driver 35, the current flow between the two pairs of sub-electrodes would cause gas discharge and generation of ultraviolet radiation or visible light in tube 6.

Since the useful life of the sub-electrodes in a cold cathode gas discharge system varies inversely with the square of the current carried by the sub-electrodes in the system, where the operating current carried by each of the sub-electrodes in pairs 8*a*, 8*b* is reduced to 2.5 milliamps from 5 milliamps, this means that the useful life of the cold cathode gas discharge system 200 can be increased by 4 times.

Each of the sub-electrodes can have a construction similar to cathodes in a normal cold cathode gas discharge system, and can be made of metal or metal with mercury alloy and getter. The installation method of the sub-electrode can be as shown in FIG. 2, each sub-electrode having a lead 30 that passes through one of the ends of the tube 6 to outside the tube.

Figure 3:
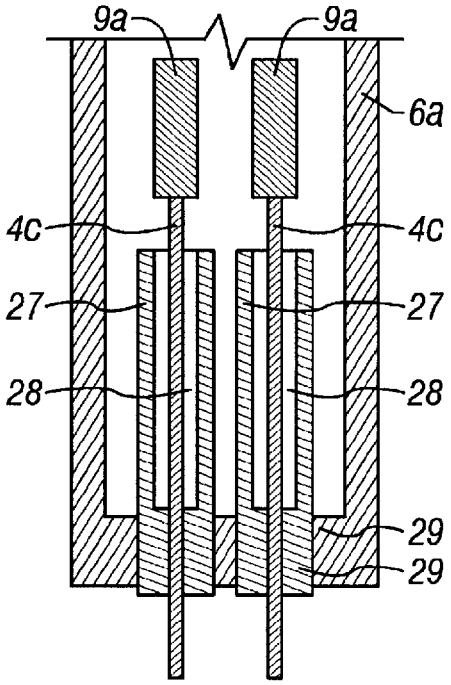
FIG. 3 is a cross-sectional view of a portion of the system of FIG. 2 to illustrate the system in more detail.

The installation method of the sub-electrode can also be as shown in FIG. 3. FIG. 3 is a cross sectional view of a pair of sub-electrodes, such as pair 8*a*, or pair 8*b*, in FIG. 2, of a cold cathode gas discharge system to illustrate a detailed construction of the system. As shown in FIG. 3, each of sub-electrodes in the pairs 8*a*, 8*b* comprises an electrode body 9*a*, lead 4*c* and a glass tube 27. As shown in FIG. 3, glass tube 27 surrounds most of its corresponding lead 4*c*, thereby leaving a corresponding gap 28 between such lead 4*c* and the tube. The gaps 28 are narrow and deep and may be used to avoid shorting between adjacent sub-electrodes caused by electrode sputtering. The glass tubes 27 may be sealingly attached with leads 4*c* to tube 6 at sealing area 29.

As shown in FIG. 2, current limiting devices 12 are employed to connect the sub-electrodes 8*a*, 8*b* to nodes 11*a*, 11*b* which are connected to a driver and an AC power supply (not shown). The function of the current limiting devices are to limit the amount of current that is delivered to the sub-electrodes. Preferably, each sub-electrode has a corresponding current limiting device that connects it to the driver and power supply, in the manner shown in FIG. 2. Thus, each of the sub-electrodes in the two pairs 8*a*, 8*b* is connected through a corresponding capacitor to a corresponding node in order to limit the amount of current that is delivered to such sub-electrode. While capacitors may be advantageously employed for coupling an AC voltage to its corresponding sub-electrode, it will be understood that other electrical components may be used instead, such as a resistor, an inductor, or any combination of capacitor, inductor, resistor. Such and other variations are within the scope of the invention.

Figure 4:
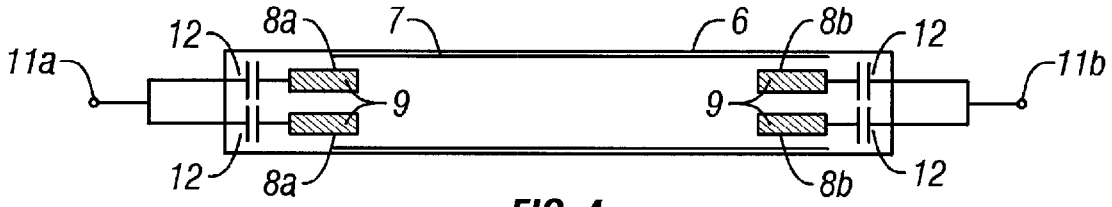
FIG. 4 is a schematic view of a cold cathode gas discharge system to illustrate an alternative embodiment to that in FIG. 2.

In FIG. 2, the current limiting devices 10 are shown as located outside tube 6. This is not essential, and these devices may be placed either inside or outside tube 6. Thus, in an alternative embodiment as shown in FIG. 4, the capacitors connecting the sub-electrode pair 8*a* to node 11*a* are placed inside the tube while the capacitors 12 connecting the pair 8*b* to node 11*b* are placed within the tube. Capacitors 12 and sub-electrode pair 8*b* may be constructed so that they form a unitary body, such as in the implementation illustrated in FIG. 5.

Figure 5:
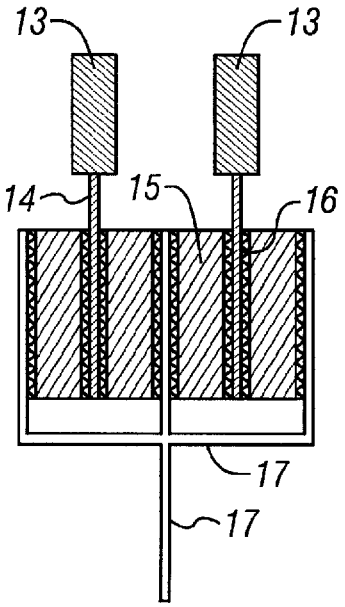
FIG. 5 is a cross-sectional view of a cathode configuration to illustrate another embodiment of the invention.
Figure 6:
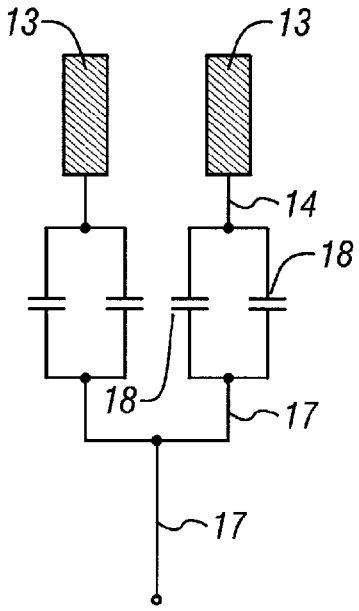
FIG. 6 is a schematic view of a circuit which is the equivalent of the electrode configuration of FIG. 5.

As shown in FIG. 5, each of the electrode structure or configuration in the sub-electrodes may include an electrode body 13, and lead 14. Each of the capacitors for such sub-electrode may be implemented as two electrically conductive layers 16 and a dielectric layer 15 between the two conductive layers 16. All of the conductive layers 16 are then connected to an electrically conductive shell 17. Thus, on each side of lead 14 are two capacitors, each formed by two electrically conductive plates 16 and a dielectric layer 15 in between, so that the two sub-electrodes and their corresponding pairs of capacitors form a unitary body as illustrated in FIG. 5. The circuit equivalent of the structure in FIG. 5 is illustrated in FIG. 6, where each of the four capacitors 18 is formed by a corresponding pair of electrically conductive plates 16 and a dielectric layer in between.

Figure 7:
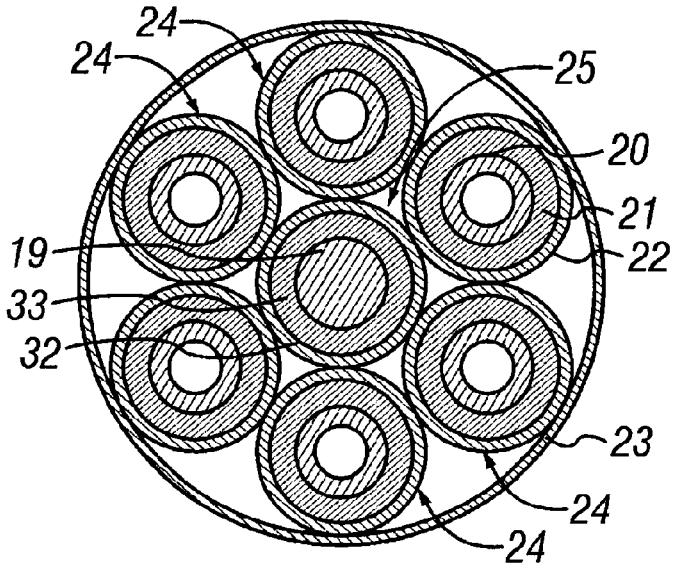
FIG. 7 is a cross-sectional view of an electrode configuration to illustrate yet another embodiment of the invention.
Figure 8:
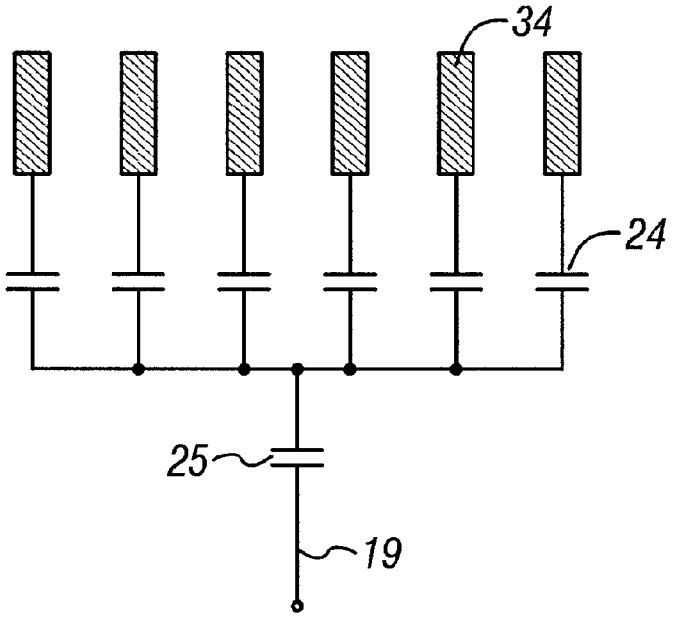
FIG. 8 is a schematic view of a circuit which is equivalent to the electrode configuration of FIG. 7.
Figure 9:
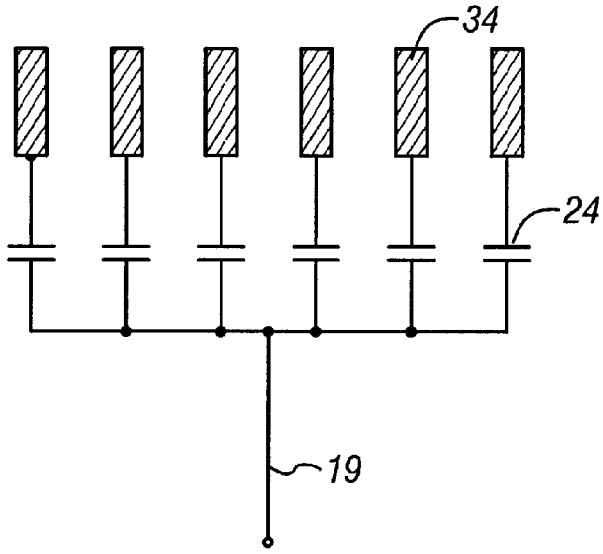
FIG. 9 is a schematic view of a circuit which is equivalent to the electrode configuration of FIG. 7, except that the series capacitor 25 of FIG. 7 has been omitted.

FIG. 7 illustrates another embodiment where a plurality of sub-electrodes and their corresponding capacitors are implemented as a unitary body. Shown in FIG. 7 is a cross-sectional view of such body. FIG. 8 is the circuit equivalent of the electrode structure in FIG. 7. As shown in FIGS. 7 and 8, lead 19 forms the connector that may be connected to a driver and an AC power supply (not shown) for supplying power to the sub-electrodes. Lead 19 is connected through a capacitor 25 to six capacitors 24, each capacitor being in the shape of a cylinder as shown in FIG. 7. Capacitor 25 is formed by lead 19 and an electrically conductive layer 32 and a dielectric layer 33 between them. The electrically conductive layer 32 of capacitor 25 is in contact with corresponding electrically conductive layer 22 of six other capacitors 24, where each capacitor 24 comprises an outer electrically conductive layer 22, an inner electrically layer 20 that also serves as the electrode body and a dielectric layer 21 sandwiched in between layers 20 and 22 as shown in FIG. 7. The entire assembly of the seven capacitors in FIG. 7 are then contained in the housing 23 whose inner cross-sectional dimensions are such that the outer layer 32 of capacitor 25 is in electrical contact with the outer layers 22 of the remaining six capacitors 24. While a capacitor 25 is employed connected in series with capacitors 24 to electrode bodies 20, it will be understood that capacitor 25 may be omitted, which will not affect the operation of the sub-electrodes in a cold cathode gas discharge system. This is illustrated in FIG. 9.

Figure 10:
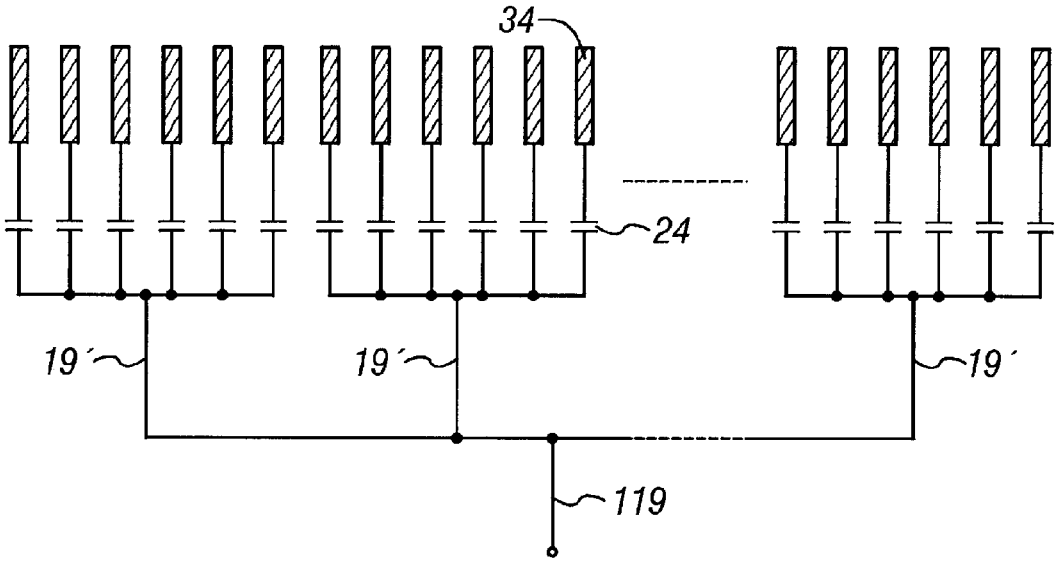
FIG. 10 is a schematic view of a circuit which may be arrived at by employing multiple electrode structures similar to that of FIG. 7.

Thus, in reference to FIGS. 7 and 8, when each of the six sub-electrodes carries 5 milliamps. of current, the six sub-electrodes together would carry 30 milliamps. The structure shown in FIG. 7 may be further extended to deliver an even higher current and therefore power in a gas discharge. Thus, if an electrical conductor 119 is electrically connected to six electrical conductors 19', and each of the six electrical conductors 19' is connected to 6 sub-electrodes in the same manner as electrical conductor 19 as shown in FIG. 7, then the total current delivered would be 6×6×5 or 180 milliamps. This is illustrated schematically in FIG. 10. By using such a tree type sub-electrode configuration, a cold cathode gas discharge system employing such structure may deliver several 100 milliamps. or over 1 ampere of current, thereby delivering high power for illumination and other purposes.

Even though sub-electrode configurations described above may be used to deliver large currents, such currents are spread over a number of sub-cathodes so that the problems caused by sputtering described above would not affect the useful life of such sub-cathodes and of the cold cathode gas discharge systems using such sub-electrodes. As compared to existing HCFL and CCFL designs, the invention is advantageous in that it is a simple and compact in structure and may be used to deliver high power and yet has a long useful life.

While the invention has been described above by reference to various embodiments, it will be understood that changes and modifications may be made without departing from the scope of the invention, which is to be defined only by the appended claims and their equivalents. All references mentioned herein are incorporated in their entirety.

What is claimed is:

1. An electrode assembly for use in a cold cathode gas discharge system, including:

at least two electrode structures, each structure including at least two sub-electrodes, said sub-electrodes in each structure connected in parallel to a source of electrical current; and a plurality of capacitors connected between the sub-electrodes and the source, wherein said sub-electrodes and capacitors comprise layers of material located adjacent to one another.

2. The assembly of claim 1, wherein each sub-electrode is connected through one of the plurality of current limiting devices to the source.

3. The assembly of claim 1, wherein said assembly includes a housing, said plurality of current limiting devices located outside the housing.

4. The assembly of claim 1, said layers of the sub-electrodes and capacitors are arranged in a stack forming a unitary body.

5. The assembly of claim 4, further comprising a shell enclosing said layers so that the layers in the body are securely connected to one another.

6. The assembly of claim 1, said layers of the capacitors being circular in shape.

7. The assembly of claim 1, each of said sub-electrodes including a lead and a sub-electrode body, said assembly further comprising at least one electrically insulating tube enclosing a lead of a sub-electrode to reduce probability of electrical shorting between such sub-electrode and other sub-electrodes.

8. The assembly of claim 1, each of said electrode structures including a plurality of sub-electrodes so that the assembly delivers more than 5 watts of power when supplied by current by the source.

9. The assembly of claim 1, each of said electrode structures comprising n sub-electrodes, n being an integer greater than 1.

10. A cold cathode gas discharge lamp, comprising:

at least two electrode structures, each structure including at least two sub-electrodes, said sub-electrodes in each structure connected in parallel to a source of electrical current;

a gas discharge medium; and a housing containing at least a portion of said sub-electrodes of each of the two electrode structures and the gas discharge medium, so that when the source applies a current across the two structures to generate light producing gas discharge in the medium, the current through the medium between the two structures will be spread over said sub-electrodes in the structures to reduce effects of sputtering on useful life of the structures during high power operation.

11. The lamp of claim 10, further comprising a plurality of current limiting devices connected between the sub-electrodes and the driver.

12. The lamp of claim 11, wherein each sub-electrode is connected through one of the plurality of current limiting devices to the driver.

13. The lamp of claim 11, said plurality of current limiting devices located outside the housing.

14. The lamp of claim 11, said current limiting devices including capacitors.

15. The lamp of claim 14, wherein said sub-electrodes and capacitors comprise layers of material located adjacent to one another.

16. The lamp of claim 15, said layers of the sub-electrodes and capacitors are arranged in a stack forming a unitary body.

17. The lamp of claim 16, further comprising a shell enclosing said layers so that the layers in the body are securely connected to one another.

18. The lamp of claim 15, said layers of the capacitors being circular in shape.

19. The lamp of claim 10, each of said sub-electrodes including a lead and a sub-electrode body, said lamp further comprising at least one electrically insulating tube enclosing a lead of a corresponding sub-electrode to reduce probability of electrical shorting between such sub-electrode and other sub-electrodes.

20. The lamp of claim 10, each of said electrode structures including a plurality of sub-electrodes so that the lamp delivers more than 5 watts of power.

21. The lamp of claim 10, the gas discharge in said lamp operating in normal glow region.

22. A method for generating light, including:

providing at least two electrode structures, each structure including at least two sub-electrodes, said sub-electrodes in each structure connected in parallel to a current source, and a housing containing at least a portion of said sub-electrodes of each of the two electrode structures and a gas discharge medium; and applying a current across the two structures to generate light producing gas discharge in the medium, wherein the current through the medium between the two structures is spread over said sub-electrodes in the structures to reduce effects of sputtering on useful life of the structures during high power operation.

23. The method of claim 22, further comprising limiting the current passing through each sub-electrode so that current passing through each sub-electrode is not higher than a set threshold.

* * * * *